United States Patent [19]

Buxton

[11] 4,168,778

[45] Sep. 25, 1979

[54] DISPENSING PACKAGE

[75] Inventor: Larry E. Buxton, St. Louis County, Mo.

[73] Assignee: Bemis Company, Inc., Minneapolis, Minn.

[21] Appl. No.: 899,408

[22] Filed: Apr. 24, 1978

[51] Int. Cl.[2] ..... B65D 85/676; B65D 83/00

[52] U.S. Cl. ..... 206/409; 206/397; 242/55.53; 242/138

[58] Field of Search ..... 242/55.53, 137.1, 137, 242/138, 146, 118.8; 206/409, 408, 397, 398, 389

[56] References Cited

U.S. PATENT DOCUMENTS

| | | | |
|---|---|---|---|
| 2,048,307 | 7/1936 | Weber | 242/146 |
| 2,180,858 | 11/1939 | Bedell | 206/408 |

*Primary Examiner*—George F. Mautz

*Attorney, Agent, or Firm*—Koenig, Senniger, Powers and Leavitt

[57] ABSTRACT

A box containing a roll of material such as a rope of tubular plastic netting, the roll having a passage extending through it axially. Each end of the box has a triangular aperture through it. When the roll rests on a first side of the box the apertures line up with the passage through the roll. In this position an arbor is inserted through the passage and the apertures. To dispense the material the box is turned over so that a second side, the side opposite the first side, is on the bottom. The arbor now rests on arbor-supporting edge portions of each aperture. The distance between each arbor-supporting edge portion and the second side is greater than the radius of the roll, so the roll is suspended above the second side of the box by means of the arbor. The roll then rotates freely in the box, permitting material to be unwound.

4 Claims, 7 Drawing Figures

DISPENSING PACKAGE

BACKGROUND OF THE INVENTION

This invention relates to dispensing packages, and more particularly to packages for dispensing material such as a rope of tubular plastic netting or the like from a roll.

Rolls of rope-like material are often transported in boxes and then removed from the box to be used. These rolls are typically wound on cores of cardboard or similar material so that when a roll is removed from its box it can be mounted, by means of an arbor extending through the core, on an unwind stand to facilitate removal of the rope from the roll. Particularly when the roll is heavy, it is necessary to suspend the roll on the unwind stand in order to allow any of the rope to be dispensed.

There are some disadvantages in this process however. Merely removing a moderately heavy roll from its transporting carton is an awkward task. The roll must somehow be raised or transferred from its position in the box to its suspended position on the unwind stand. And there is always the possibility that the roll might be dropped after removal from the box, thereby damaging the rope or crushing the core. Occasionally a core is so crushed that the unwind arbor cannot be inserted through the core, thereby making unwinding of the rope an unnecessarily difficult chore.

SUMMARY OF THE INVENTION

Among the several objects of the present invention may be noted the provision of a dispensing package for dispensing material such as a rope of tubular plastic netting or the like from a roll which eliminates the problems involved in removing the roll from its box; the provision of such a package which obviates the need for a separate unwind stand; the provision of such a package that reduces the possibility of damage to the rope and crushing of the core caused by dropping the roll; and the provision of such a package that facilitates the dispensing of the rope of tubular plastic netting or the like from the roll.

Briefly, the dispensing package of the present invention includes a box having opposed end walls and opposed first and second sides. Each of the end walls has an aperture therethrough in general registry with the aperture in the opposite wall. The package also includes a roll of material such as a rope of tubular plastic netting or the like having a passage extending axially therethrough. The roll, which extends endwise of the box and has a diameter less than the distance between the first and second sides, is adapted to rest on the first side of the box when the latter is positioned with the first side as the bottom. The apertures are disposed a distance from the first side corresponding to the radius of the roll for insertion of an arbor through the aperture at one end, the passage in the roll and the other aperture when the box is positioned with the first side as the bottom. Each end wall has an arbor-supporting edge portion at the aperture therein on the side of the aperture toward the second side of the box which is spaced from the second side a distance greater than the radius of the roll. On turning over the box to rest on the second side after an arbor has been inserted through the passage in the roll and both apertures, the arbor engages the arbor-supporting edge portions and the roll is suspended by the arbor above the surface of the second side, thereby permitting material to be unwound from the roll while it is in the box.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
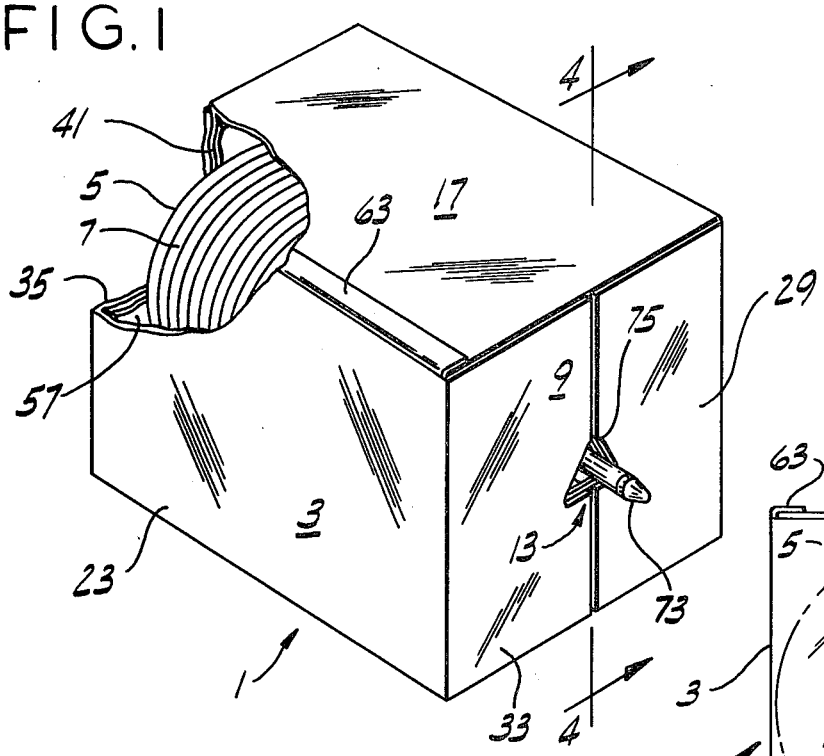
FIG. 1 is a perspective of the dispensing package of this invention with one corner broken away.
Figure 7:
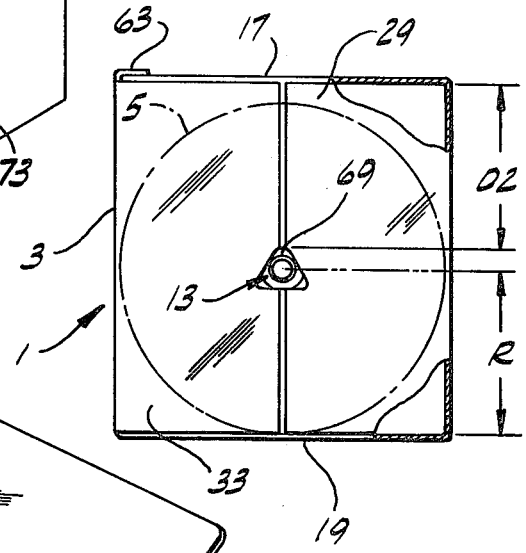
FIG. 7 is a right side elevation of the package of the present invention with parts broken away.
Figure 2:
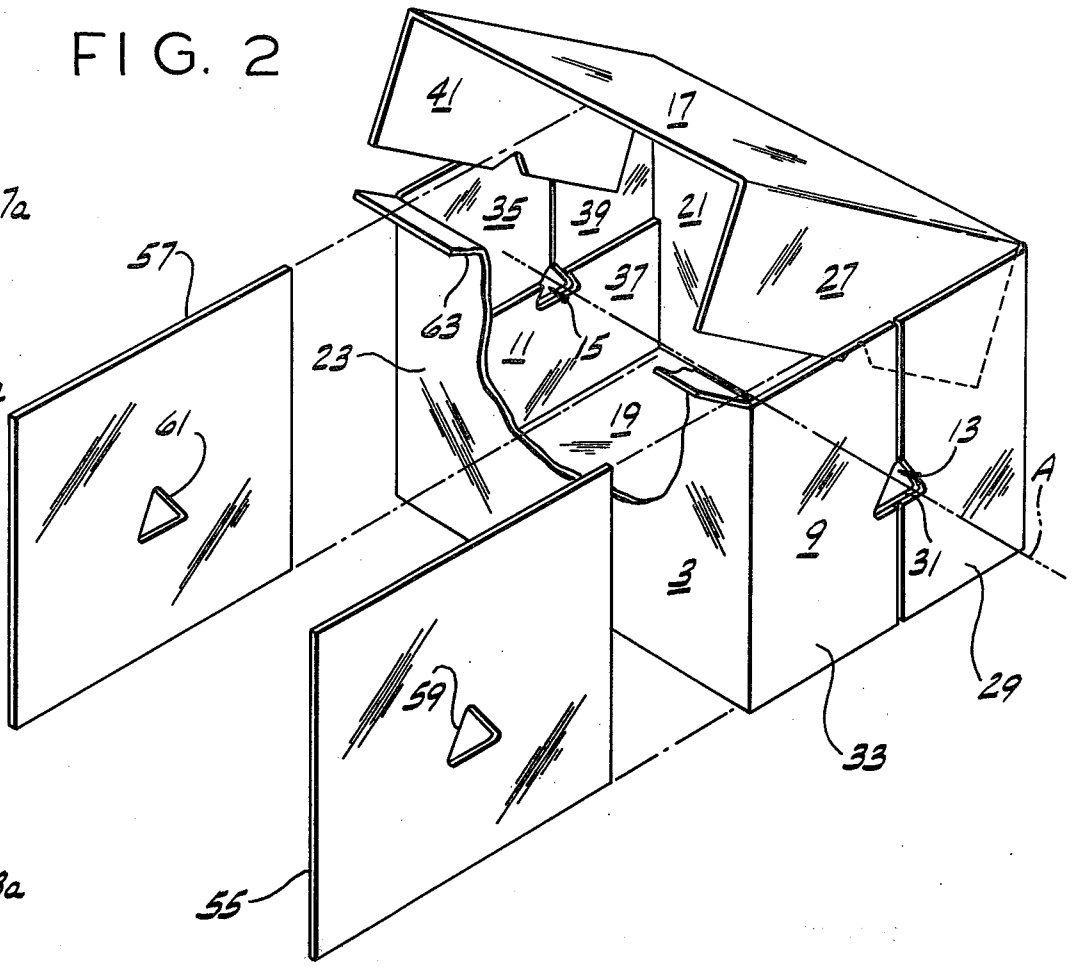
FIG. 2 is a perspective of the dispensing package of this invention as viewed from the same angle as FIG. 1 with the contents of the package removed and the box of the package partially disassembled.
Figure 4:
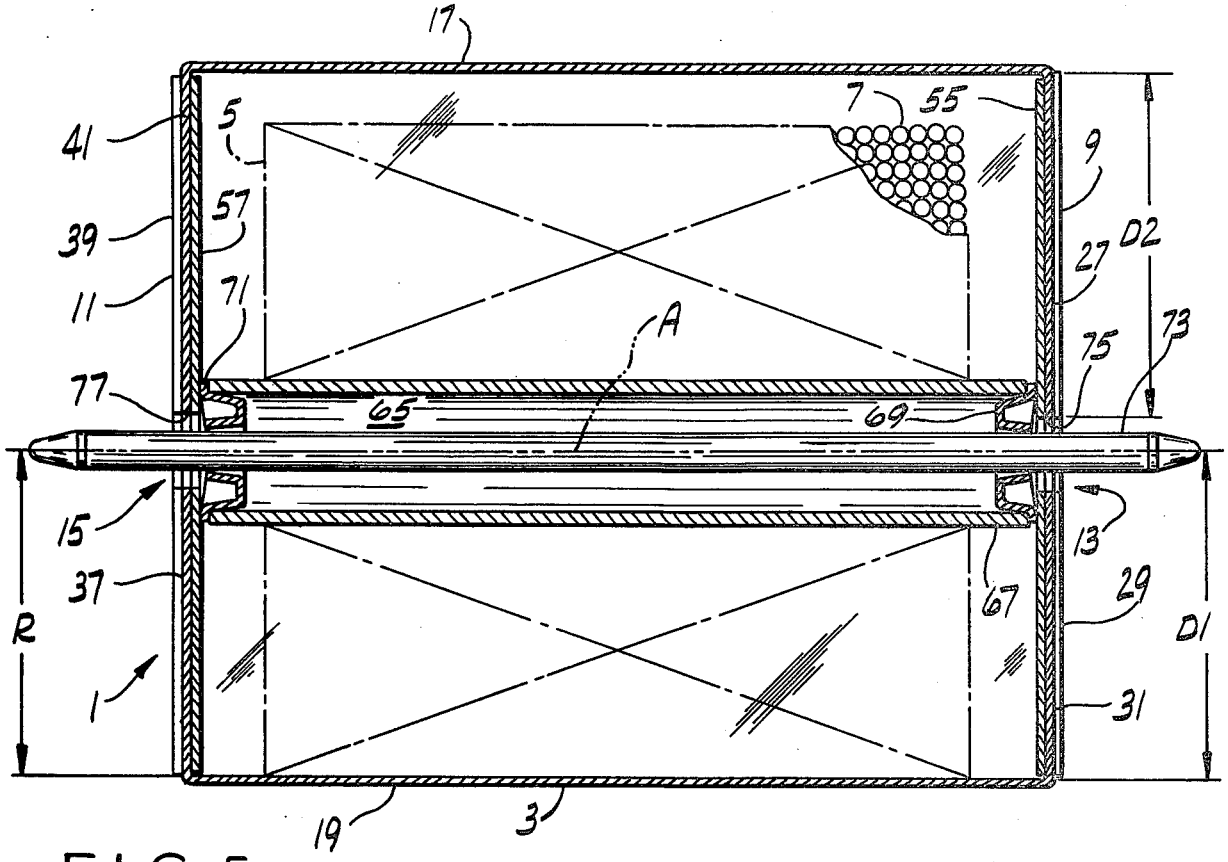
FIG. 4 is a vertical section on line 4—4 of FIG. 1 on an enlarged scale, with the package of the present invention in an arbor-inserting position.

Referring now to the drawings, there is shown a dispensing package 1 comprising a box 3 containing a roll 5 of material such as a rope 7 of tubular plastic netting or the like to be dispensed (FIG. 1). The radius of roll 5 is indicated by the reference character R (FIGS. 4 and 7). As can be more clearly seen in FIG. 2, the box has opposed end walls 9 and 11 having triangularly-shaped apertures 13 and 15 therethrough, which apertures are in general registry with each other and define an aperture axis A. The four sides of box 3 are designated 17, 19, 21 and 23. The distance between the aperture axis and side 19 is indicated by the reference character D1. Additionally, the distance from the apex of each aperture to side 17 is indicated by the reference character D2. As appears in FIGS. 4 and 7, R is generally equal to D1. D2 also appears as generally equal to R and D1, and in any event is such that its length plus the radius of an arbor which is to be inserted in the roll (as will be described) is greater than R.

Figure 3:
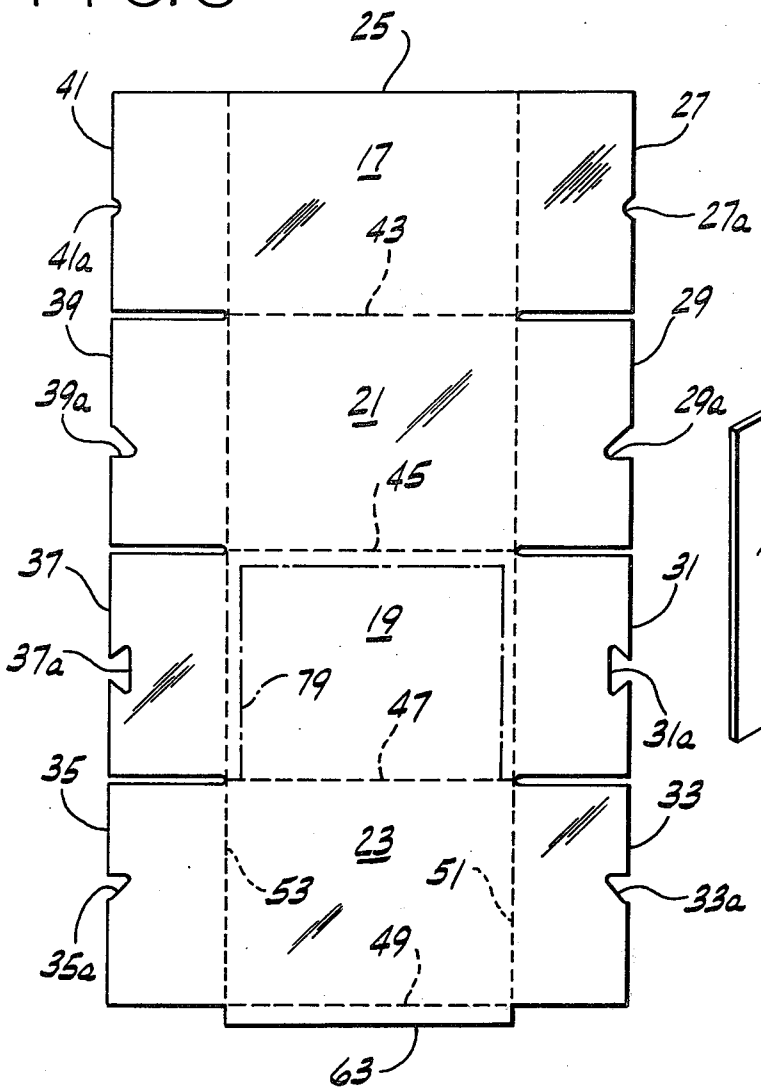
FIG. 3 is a plan of the box blank used in constructing the package of the present invention.

Box 3 is made of some suitable strong, light-weight material such as cardboard, and ends 9 and 11 are of three-layer construction for additional strength. FIG. 3 shows a flat, pre-cut sheet or blank 25 of cardboard from which box 3 is formed. Sheet 25 includes four panels forming the four sides 17, 19, 21 and 23 of the box, and eight end flaps 27, 29, . . . , 41 each having a notch, indicated by the reference characters *27a*, *29a*, . . . , *41a*, stamped therein. The notches are disposed at such positions along the length of the outer edges of their respective end flaps and are so shaped that when sheet 25 is folded on the fold lines indicated at 43, 45, 47, 49, 51 and 53 (where the sheet may be scored) to make box 3 they form the triangular apertures 13 and 15. Flaps 27 and 31 form the intermediate layer of the three-layer end wall 9 while flaps 29 and 33 form the outer layer. Likewise flaps 37 and 41 form the intermediate layer of the three-layer end wall 11 while flaps 35 and 39 form the outer layer. Separate cardboard panels 55 and 57 having triangular openings 59 and 61 therein form the inner layers of walls 9 and 11. Openings 59 and 61 are in registry with apertures 13 and 15 and form a part thereof. Box 3 is loaded with roll 5 at the factory, and is glued or fastened shut. The sheet or blank 25 is formed with a side flap 63 which is folded over a portion of side 17 and secured thereto to seal the box. Apertures 13 and 15 are covered by a suitable protective tape (not shown) during shipment to prevent foreign matter from entering the box.

Referring to FIG. 4, roll 5 has a passage 65 extending axially therethrough. Specifically, rope 7 is wound on a hollow core 67 to form roll 5 and the interior of core 67 forms passage 65. Two plugs 69 and 71 are secured in the ends of core 67, each plug having a central bore.

To unroll rope 7 from package 1, the user positions the package as shown in FIGS. 1 and 4 resting on its side 19, removes the protective tape from apertures 13 and 15, and inserts an arbor 73 through passage 65 and apertures 13 and 15. Specifically, arbor 73 passes through the bores in plugs 69 and 71, which plugs ensure that arbor 73 is inserted along the axis of roll 5. Alternatively, core 67 can be chosen to be just slightly larger than arbor 73, thereby eliminating the need for plugs 69 and 71.

In the arbor inserting position, side 17 is the top of package 1, side 19 is the bottom, and the apices of triangular apertures 13 and 15 point toward the top of package 1. Roll 5, which has a diameter less than the distance between sides 17 and 19, rests on side 19 when package 1 is in this position. Since distance D1 equals radius R, the axis of roll 5 substantially coincides with the axis of apertures 13 and 15 when the package is in this position and arbor 73 is insertable through both apertures and passage 65.

Figure 6:
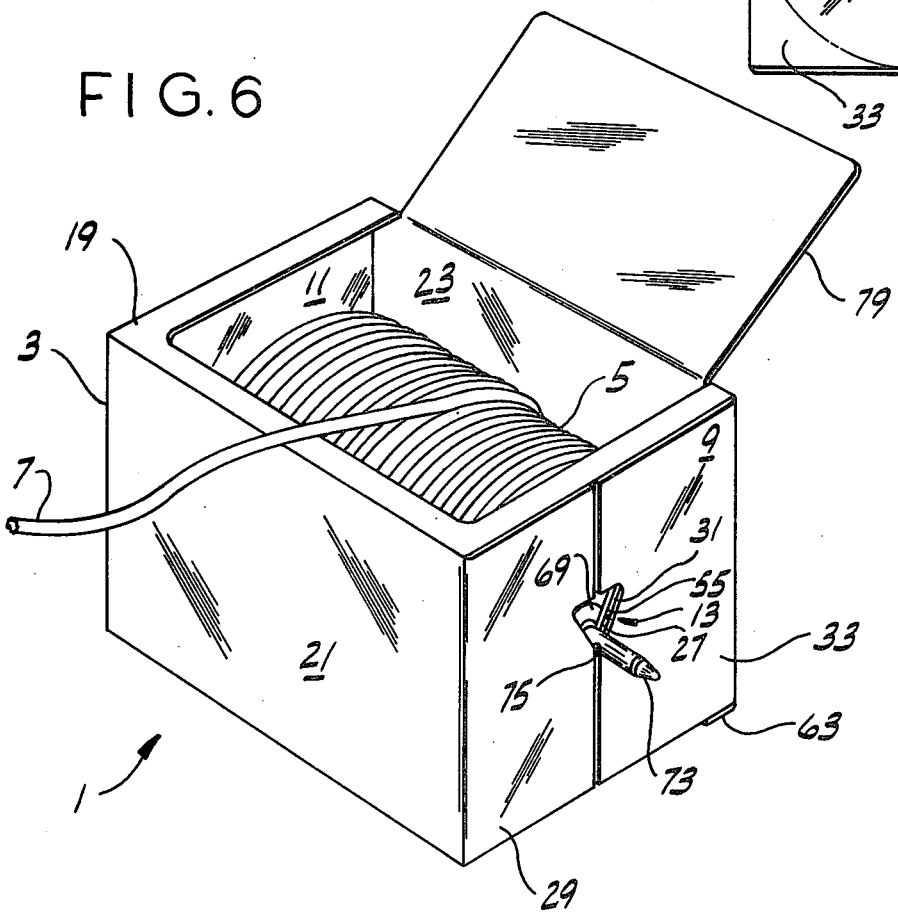
FIG. 6 is a perspective of the dispensing package of this invention in its dispensing position with rope being dispensed from the package.
Figure 5:
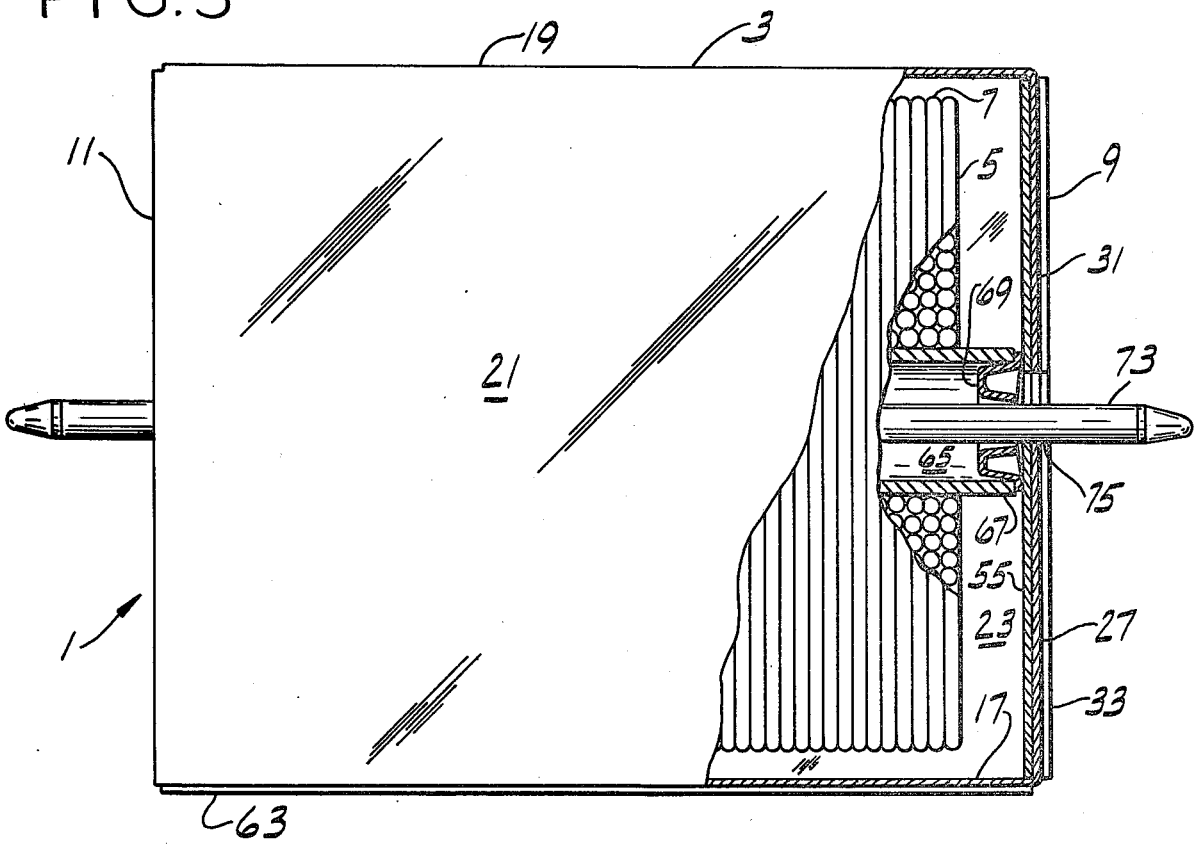
FIG. 5 is a front elevation of the dispensing package of this invention in its dispensing position with portions broken away.

After arbor 73 is inserted through passage 65 and apertures 13 and 15, however, box 3 is turned over to rest on side 17 (FIGS. 5 and 6). The apices of apertures 13 and 15 i.e. the sides of the apertures disposed toward side 17 of the box, now provide V-shaped arbor-supporting edge portions 75 and 77 in end walls 9 and 11 for cradling arbor 73. Therefore, in this position, the weight of roll 3 is transmitted through plugs 69 and 71 to arbor 73 and through arbor 73 to edge portions 75 and 77. The distance between the center of the axial passage and those points where plugs 69 and 71 are in contact with the arbor, and hence are transmitting the weight of the roll to the arbor, is the effective radius of the passage 65. When plugs 69 and 71 are used, the effective radius of passage 65 is, of course, the radius of the bores in those plugs. When the alternative described above of eliminating the plugs is used, the effective radius of passage 65 is the inside radius of core 67 itself. Since distance D2 plus the radius of the arbor is greater than radius R, and in particular since the diameter of the arbor plus the distance between the arbor-supporting edge portion and the second side is greater than the radius of the roll plus the effective radius of the axial passage, the roll is thereby suspended above side 17. Edge portions 75 and 77 are of triple-thickness, as are the other portions of walls 9 and 11, in order to bear the weight of roll 5 without collapsing or tearing. Of course, the thickness of edge portions 75 and 77 can be varied depending upon the materials used in making said edge portions and walls 9 and 11.

Once roll 5 is properly suspended above the bottom (side 17) of box 3, a panel 79 (shown in phantom in FIG. 3) is removed or folded back to reveal roll 5. Rope 7 is then rolled off roll 5 and removed from box 3 very easily. Because roll 5 is suspended above side 17 it rotates on arbor 73 as rope is removed therefrom, thereby facilitating the dispensing of the rope.

In view of the above, it will be seen that the several objects of the invention are achieved and other advantageous results attained.

As various changes could be made in the above products without departing from the scope of the invention, it is intended that all matter contained in the above description or shown in the accompanying drawings shall be interpreted as illustrative and not in a limiting sense.

What is claimed is:

1. A dispensing package for dispensing material such as a rope of tubular plastic netting or the like from a roll comprising:

a box having opposed end walls and opposed first and second sides, each of said end walls having an aperture therethrough in general registry with the aperture in the opposite wall, said apertures each having sides including a side disposed toward the second side of the box, a roll of material such as a rope of tubular plastic netting or the like having a passage extending axially therethrough and being adapted to rest on the first side of the box when the box is positioned with the first side as the bottom, said roll extending endwise of the box and having a diameter less than the distance between said first and second sides, said axial passage having an effective radius, said apertures being disposed a distance from the first side corresponding to the radius of the roll for insertion of an arbor through the aperture at one end, the passage in the roll and the other aperture when the box is positioned with the first side as the bottom, each end wall having an arbor-supporting edge portion at the aperture therein on the side of the aperture toward said second side, the sum of the diameter of the arbor and the distance between said arbor-supporting edge portion and the second side being greater than the radius of the roll plus the effective radius of the axial passage, so that on turning the box over to rest on said second side after the arbor has been inserted through said passage and both apertures the arbor engages said arbor-supporting edge portions and the roll is suspended by said arbor above the surface of said second side, thereby permitting material to be unwound from the roll while it is in the box.

2. A dispensing package as set forth in claim 1 wherein a part of the box is removable to permit removal of the unwound material from the box.

3. A dispensing package as set forth in claim 1 wherein the apertures are substantially triangular in shape.

4. A dispensing package as set forth in claim 3 wherein each of the triangular apertures has an apex toward said second side of the box providing a V-shaped arbor-supporting edge portion for cradling the arbor.

* * * * *